United States Patent [19]

Mizusawa et al.

[11] 4,186,402

[45] Jan. 29, 1980

[54] CASSEGRAINIAN ANTENNA WITH BEAM WAVEGUIDE FEED TO REDUCE SPILLOVER

[75] Inventors: Motoo Mizusawa, Kamakura; Chikao Kinoshita, Amagasaki; Shinichi Betsudan, Amagasaki; Sigeru Sato, Amagasaki, all of Japan

[73] Assignee: Mitsubishi Denki Kabushiki Kaisha, Tokyo, Japan

[21] Appl. No.: 946,619

[22] Filed: Sep. 28, 1978

Related U.S. Application Data

[63] Continuation of Ser. No. 798,170, May 18, 1977, abandoned.

[30] Foreign Application Priority Data

May 18, 1976 [JP] Japan ..... 51-57503

[51] Int. Cl.[2] ..... H01Q 19/14; H01Q 3/12

[52] U.S. Cl. ..... 343/781 CA; 343/837

[58] Field of Search ..... 343/781 R, 781 D, 781 CA, 343/761, 837, 840

[56] References Cited

U.S. PATENT DOCUMENTS

| | | | |
|---|---|---|---|
| 3,821,746 | 6/1974 | Mizusawa et al. | 343/781 CA |
| 4,044,361 | 8/1977 | Yokoi et al. | 343/781 CA |
| 4,062,018 | 8/1976 | Yokoi et al. | 343/781 CA |

*Primary Examiner*—Eli Lieberman

*Attorney, Agent, or Firm*—Oblon, Fisher, Spivak, McClelland & Maier

[57] ABSTRACT

An aerial system (antenna system) comprises dual-reflector aerial consisting of a main reflector and subreflector;

a primary feed whose input and output ends are fixed for elevation and azimuth rotation of said dual-reflector aerial;

a plane reflector which is turned together with said dual-reflector aerial around an elevation rotating axis;

a first curved reflector for reflecting waves generated from said primary feed; and second and third curved reflectors which sequentially reflect to lead the wave reflected by said first curved reflector to said plane reflector.

5 Claims, 6 Drawing Figures

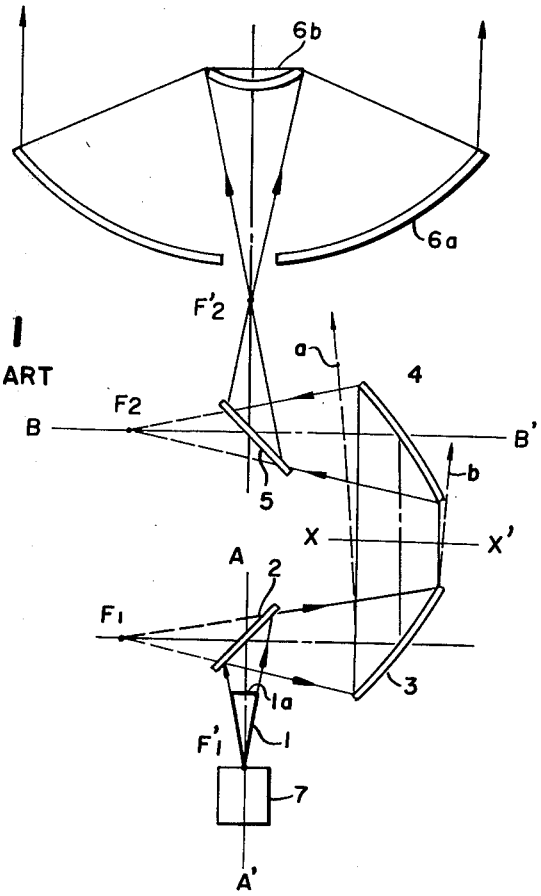
FIG. 1
PRIOR ART
FIG. 2
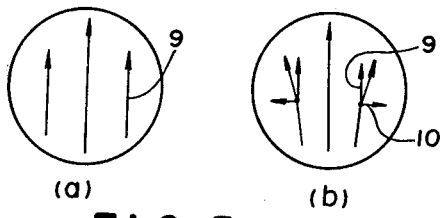
FIG. 3
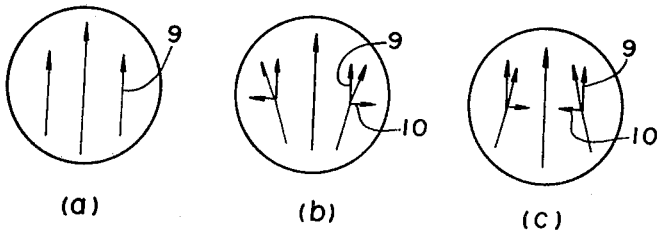

CASSEGRAINIAN ANTENNA WITH BEAM WAVEGUIDE FEED TO REDUCE SPILLOVER

This is a continuation of application Ser. No. 798,170, filed May 18, 1977, now abandoned.

Background of the Invention

1. Field of the Invention

This invention relates to the improvement of a steerable aerial system (an antenna system) including a beam-waveguide feeder system employing rotationally asymmetric reflectors for the purpose of transmitting electromagnetic waves between a primary feed point and the aerial itself through one or more axes of rotation, with particular application to a microwave aerial for use with a satellite communications system.

2. Description of Prior Art

A previous aerial system for an earth station of a satellite communication system has been composed of a dual-reflector aerial such as a Cassegrainian or Gregorian type having a main reflector, a subreflector and a primary feed for supplying microwave power to the aerial, which feed is coupled to the dual-reflector aerial by a beam waveguide comprising two concave reflectors and two plane reflectors so disposed as to couple the microwave power between the dual-reflector aerial, which together with one of the plane reflectors is capable of being rotated about an elevation axis, and the primary feed located on a fixed mount low on the aerial system structure, while permitting the dual-reflector aerial and beam waveguide together to be rotated about an azimuth axis. In an endeavour to minimize power losses from the beam, undesirable cross-polarisation effects and aerial beam asymmetry, a beam-waveguide fed aerial system has heretofore employed two rotationally asymmetric concave paraboloid reflectors in fixed mirror-image relation to each other and two plane reflectors so mounted as to turn the beam through a right angle without distortion at the axes of rotation of the aerial system. Such a system using a pair of paraboloid reflectors presupposes the generation of a parallel beam by these reflectors, whereas in practice, due to diffraction effects resulting from the fact that the reflectors used are not extremely large relative to the wavelength used, there is in effect a defocussing of the beam which causes spilling over of the microwave power leading to a reduction in aerial performance and potential hazard to maintenance staff from stray microwave radiation. In order to overcome this effect when using such an arrangement of paraboloid reflectors, or any other geometrically-derived arrangement, it is necessary to enlarge the reflectors to prevent spillover, thus causing an undesirable increase in the size of the structure. Further, the use of two mirror-image curved reflectors in fixed relationship to each other is intended to ensure that the undesirable wave distortion introduced by the first curved reflector is completely cancelled by the second curved reflector, thereby maintaining aerial beam symmetry and avoiding cross-polarisation distortion and tracking errors. However, due to the divergence of the beam, the cross-polarisation introduced at the second reflector is greater than that at the first and cancellation is incomplete at the second reflector. While this effect is generally not large enough to cause serious degradation of performance due to noise pick-up or tracking errors, it does introduce a significant cross-polarised component into the transmitted wave which is undesirable, especially in view of the introduction into satellite communications systems of a method of frequency-spectrum re-use involving the transmission or reception of a pair of independent signals sharing a common frequency and discriminated only by having orthogonal polarisations, whether linear or circular.

SUMMARY OF THE INVENTION

An object of the present invention is therefore to improve the cross-polarisation characteristics of a beam-waveguide fed aerial system, thereby enhancing its performance, especially when used with a frequency re-use satellite communications system employing orthogonal wave polarisations.

Another object of the present invention is to improve the beam focussing within a beam-waveguide fed aerial system, thereby enabling the necessary performance to be obtained within smaller overall dimensions than would otherwise be possible.

In accordance with the present invention, there is provided a steerable microwave aerial system wherein the microwave energy is conveyed between a moveable aerial portion and a fixed portion containing a primary feed, by means of a four-reflector beam waveguide, with the four-reflector beam waveguide together with the moveable aerial portion being rotatable relative to the fixed portion about a first axis and the moveable aerial portion being further rotatable about a second axis, the four-reflector beam waveguide comprising a first curved reflector mounted on the first axis, a second curved reflector, a third curved reflector mounted on the second axis and a plane reflector also mounted on the second axis but being rotatable together with the moveable aerial portion about the said second axis relative to the remainder of the four-reflector beam waveguide, the reflectors being so disposed and the curved reflectors being of such curvatures as to reflect without loss due to spillover microwave radiation emanating from a focal point of the primary feed lying on the first axis via the first curved reflector to the second curved reflector, thence to the third curved reflector, from there along the second axis to the plane reflector and thence to a focal point of the moveable aerial portion lying in a plane normal to the second axis, while the mode of transmission of the microwave radiation is maintained unchanged at the focal points of the primary feed and the moveable aerial portion.

BRIEF DESCRIPTION OF THE DRAWINGS

An embodiment of the present invention will now be described in detail by way of example, with reference to the accompanying drawings, in which:

FIG. 1 shows in longitudinal section the construction of a prior-art dual-reflector aerial system employing a four-reflector beam-waveguide feed using two plane and two curved reflectors;

FIGS. 2(*a*) and 2(*b*) show the electric field distributions expected from application of classical ray-optical analysis to exist within the prior-art four-reflector beam waveguide system;

FIGS. 3(*a*), 3(*b*) and 3(*c*) show the electric field distributions existing within the prior-art four-reflector beam waveguide system;

DETAILED DESCRIPTION OF THE PREFERRED EMBODIMENTS

Figure 4:
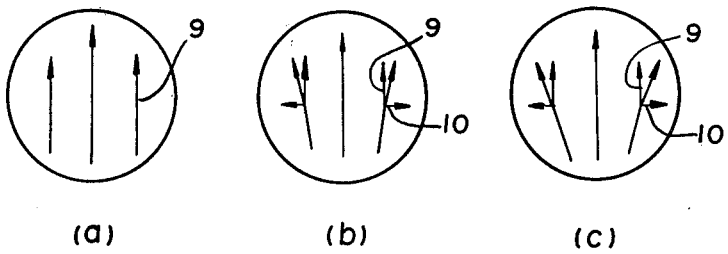
FIGS. 4(*a*), 4(*b*) and 4(*c*) show the electric field distributions within a four-reflector beam waveguide system constructed according to the present invention.

Referring to FIG. 1, which shows in longitudinal section a prior-art beam-waveguide fed aerial system, the primary feed 1 comprising an electromagnetic horn, having its aperture marked 1*a* in the figure, is placed with its focal point coincident with focal point $F_1'$ of the beam waveguide system. This focal point $F_1'$ is the image of focal point $F_1'$ of the paraboloid reflector 3 as reflected by plane reflector 2. A—A' is the azimuth axis of the aerial system. The transmitted electromagnetic wave travels from the primary feed 1 to the first plane reflector 2 where it is directed towards the first paraboloid reflector 3. Since paraboloid reflector 3 lies obliquely to the incident direction of the wave, the wave is distorted on reflection. In order to cancel out this distortion, the second paraboloid reflector 4, lying on the elevation axis of the aerial system, is made to be a mirror image in plane X—X' of the first paraboloid reflector 3. The wave directed to the second paraboloid reflector 4 from the first paraboloid reflector 3 is thus reflected towards focal point $F_2$ with the distortions introduced by the two oblique paraboloid reflectors largely cancelled out due to their symmetrical disposition. Between the second paraboloid reflector 4 and the focal point $F_2$ is interposed a second plane reflector 5 which re-directs the wave to a new focus at $F_2'$ which is arranged to coincide with the focal point of a dual-reflector aerial 6*a*, 6*b* which may be of Cassegrainian or Gregorian type, or one of the constant aperture-phase microwave analogues of either of these two types. Since the focal points of the primary feed and the dual-reflector aerial coincide with those of the four-reflector beam-waveguide feed and the distortions in the beam waveguide system are largely cancelled out, it is almost as if the primary feed were located at the focus of the dual-reflector aerial and an aerial system having good performance characteristics can be constructed, with the advantage over other types that the primary feed 1 and the transmitting and receiving equipment 7 desired to be connected closely with it can be located in a stationary room at or near ground level thereby allowing easy access for operation and maintenance, while the aerial can be steered as required to point towards the satellite. The type of beam-waveguide, system described above has therefore been used in high-performance aerial systems having easy access to the transmitting and receiving equipment.

The prior-art four-reflector beam waveguide system has, however, been disadvantageous in that no account is taken of diffraction effects arising from the fact that in a practical microwave aerial system the reflectors used in a beam waveguide system feeding it cannot be greater than about 20 wavelengths across. In general, when an electromagnetic wave is reflected from a surface whose dimensions are not considerably greater than one wavelength, the reflected rays diverge, due to the effects of diffraction, from the paths predicted by classical straight-line ray optics, and it is found that a reflector which by this theory would be expected to produce a focussed parallel beam in fact produces a divergent beam. Thus if, as in FIG. 1, a paraboloid reflector 3 is used with the intention of focussing a wave emanating from its focal point $F_1$ into a parallel beam incident upon a second reflector 4 of equal dimensions, the focussing is imperfect and a part of the energy, represented by divergent curved rays "a" and "b," inevitably misses the second reflector, causing what is known as "spillover." This effect is further compounded on reflection of the beam towards the second plane reflector 5 due to the divergent, as opposed to parallel, nature of the beam incident upon the second paraboloid reflector 4 causing further defocussing. This has deleterious effects on the performance of the aerial system, especially in respect of beam misalignment, signal loss and increased noise and susceptibility to interference arising both from within the beam waveguide and from the resulting increase in aerial sidelobe level, while the stray microwave energy is potentially hazardous to operating staff. To combat this effect in order to obtain adequate aerial system performance, a beam-waveguide fed aerial system constructed according to the prior art has to use larger reflectors than would otherwise be necessary, which is disadvantageous in that a larger supporting structure has to be used and the protective shield within which a beam waveguide is commonly enclosed is also necessarily enlarged. Further, if the first paraboloid reflector 3 is arranged obliquely relative to an axially symmetric incident wave having the electric-field distribution shown in FIG. 2(*a*), the reflected wave will no longer be axially symmetric and a cross-polarised component 10 shown in FIG. 2(*b*) will be superimposed upon the principal wave 9. By application of straight-line ray optics it is predicted that placing a second paraboloid reflector 4 in a mirror-image relationship to the first will cause complete concellation of this distortion and it is the intention of a beam waveguide system constructed according to the prior art so to restore the electric field configuration to that of FIG. 2(*a*) upon reflection from the second reflector. Now it can be shown by the mathematical technique known as Spherical Wave Expansion that the magnitude of the cross-polarised component introduced into a wave by an oblique asymmetric curved reflector increases as the area of the reflector illuminated increases. (For an exposition of this technique, reference is made to a paper by R. Ludwig Published in the Transactions of the Institute of Electrical and Electronics Engineers, of New York U.S.A. Volume AP-19, No. 3, Page 214, March 1971). Since in the prior-art beam-waveguide system the beam between the two paraboloid reflectors 3 and 4 in FIG. 1 is divergent, a greater area of the second paraboloid reflector 4 is illuminated than is the case with the first paraboloid reflector 3 and therefore a larger degree of cross-polarisation is induced at the second such reflector than was induced at the first. The effect on transmission is shown in FIGS. 3(*a*), 3(*b*) and 3(*c*), where FIG. 3(*a*) shows the transverse electric field distribution of the axially symmetric wave incident upon the first curved reflector 3 of a beam waveguide system constructed according to FIG. 1 wherein the first reflector 2 is plane. On reflection from the first paraboloid reflector 3 towards the second paraboloid reflector 4 the wave is distorted due to the oblique disposition of the first paraboloid reflector and contains a cross-polarised component 10 as shown in FIG. 3(*b*) superimposed upon the principal wave 9. However, instead of introducing an equal and opposite compensatory distortion to the wave as intended, as shown above the second paraboloid reflector 4 introduces a distortion which is greater than that produced by the first paraboloid reflector 3 and the result is to cause in effect an over-compensation leading to the wave reflected from the second paraboloid reflector 4 towards the second plane reflector 5 containing a residual cross-polarised component 10 as illustrated in FIG. 3(*c*). This causes an undesirable asymmetry in the beam radiated by the aerial system, a degradation due to the spurious generation of higher transmission modes of the performance of any tracking system which operates by detecting such modes, and especially, in the event that the aerial is to be used in a communications system where different signals at the same frequency are distinguished by having orthogonal polarisations, undesirable mixing of the orthogonally-polarised signals leading to a degradation in the performance of the communications system taken as a whole. The present invention is thus aimed at the application to a four-reflector beam waveguide of new methods whereby spillover within the reflector system is reduced to a minimum while making the most economical use of the reflector area, and cancellation of the aberrations introduced by the oblique curved reflectors is improved. The improved beam-waveguide fed aerial system and the methods used to obtain these improvements will now be described by means of the drawings.

Figure 5:
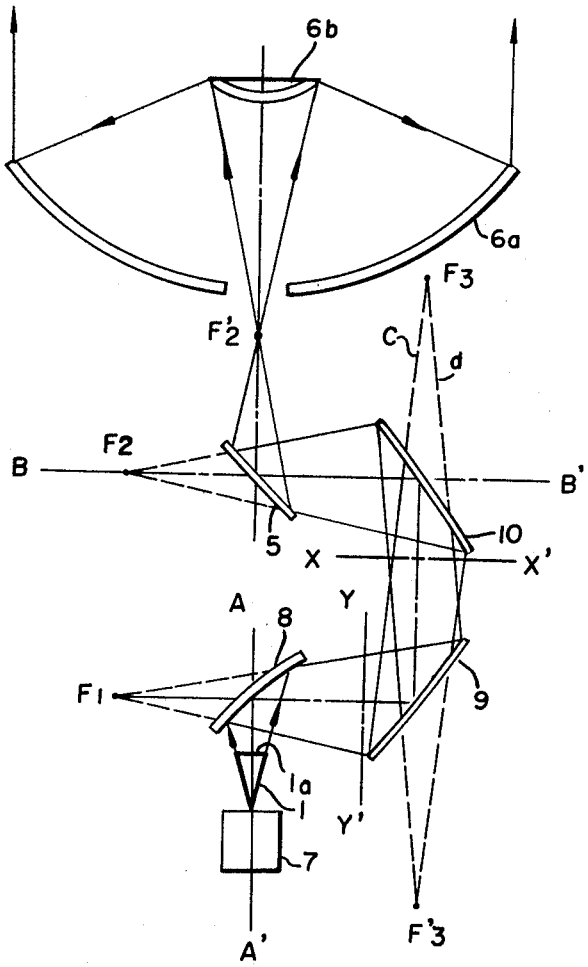
FIG. 5 shows in longitudinal section an embodiment of the present invention.

An embodiment of the present invention is shown in longitudinal section in FIG. 5. While this embodiment is described herein as it is applied to a transmitting aerial system, it is also applicable to a receiving aerial system. An electromagnetic wave generated by a transmitter located in the communications equipment room 7 is radiated from an electromagnetic horn 1 such that it forms an axially symmetric spherical wave with its apparent origin at focal point $F_1'$. The wave is then reflected through an angle of ninety degrees by an offset hyperboloid reflector 8 which is so shaped that an exact, predetermined amount of distortion is introduced into the wave. Subsequently the wave is further reflected by a pair of offset ellipsoid reflectors 9 and 10 which are arranged to be mirror images of each other. By further reflection at a plane reflector 5 the wave is brought to a focus at focal point $F_2'$ which is arranged to coincide with the focal point of the dual-reflector aerial 6*a*, 6*b* with the result that the wave reflected onto the main reflector 6*a* from the subreflector 6*b* is then reflected along the axis of the main reflector in the form of a narrow-beam plane wave.

Since even a so-called geostationary satellite moves periodically with respect to a point on the earth's surface, it is necessary to change the direction to which the axis of the main reflector, and hence that of the transmitted beam, points. It is possible to do this without distorting the transmitted beam by ensuring that the axes of rotation of the aerial system act at points within the beam-waveguide feeder at which the beam is axially symmetric. Thus in FIG. 5 if main reflector 6*a*, subreflector 6*b* and plane reflector 5 are kept in fixed relation to each other and are together rotated about a horizontal axis B—B', it is possible to alter the angle of elevation of the transmitted beam without distortion since the wave incident on the plane reflector from ellipsoid reflector 10 is arranged to have symmetry about axis B—B' and the plane reflector also has symmetry about this axis. Further, since the wave emanating from the horn 1 has axial symmetry it is possible to rotate the whole system of reflectors together about a vertical axis A—A' relative to the fixed horn and equipment room 7 without distorting the transmitted wave, provided only that the spatial relationship between reflectors 8, 9 and 10 and axis B—B' is kept fixed. Thus steering of the aerial beam in both azimuth and elevation axes is possible with this embodiment of the present invention without degradation of performance.

Figure 6:
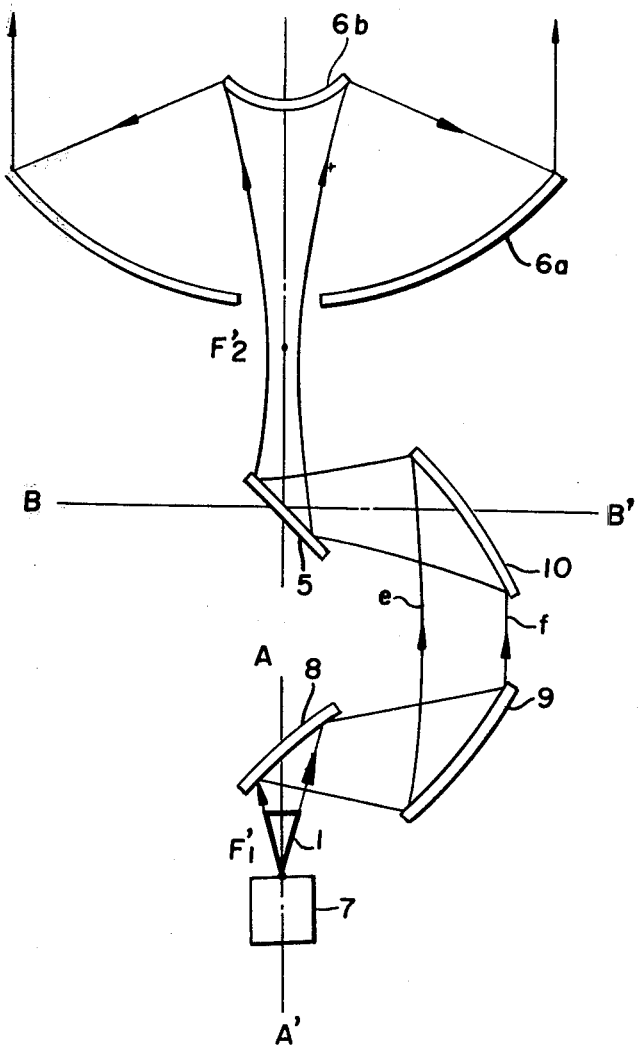
FIG. 6 shows in longitudinal section an embodiment of the present invention, with illustration of the curved ray paths predicted according to the principles of wave theory.

As stated above, in the present invention the curved reflector 9 shown in FIG. 5 is an ellipsoid. If straight-line ray optics could be applied, a wave emanating from its first focal point $F_1$ would be brought to a focus at its second focal point $F_3$ as shown by the produced straight-line rays "c" and "d." The beam thus reflected from this reflector would therefore be convergent. However, since this reflector is in the order of 20 wavelengths across, classical straight-line ray optics does not apply other than approximately and the beam is found to diverge from the straight-line ray paths as drawn. Since the wave reflected from such an ellipsoid thus has opposing convergent and divergent tendencies, it is therefore possible by selection of a suitable curvature for reflector 9 to be able to arrange that a second reflector of the same size can be placed at such a distance from the first that it is fully illuminated by the reflected wave without spillover. Such an arrangement is shown in FIG. 5 where reflectors 9 and 10 are both ellipsoids being mirror images of each other and so placed that reflector 9 if illuminated by a wave emanating from its focal point $F_1$ will illuminate the whole area of reflector 10 without spillover, while reflector 10 if illuminated from its focal point $F_2$ will in turn similarly fully illuminate reflector 9 without spillover. The system is therefore fully reciprocal and yet allows fullest use to be made of the whole area of each reflector in both transmission and reception modes. In aerial systems parlance this arrangement of reflectors is said to be "efficient." FIG. 6, which shows a further longitudinal section of this embodiment of the present invention, with the numbering of the several parts following that of FIG. 5, shows a notable feature of this invention, namely that the combination of convergent and divergent properties within the one beam causes the beam passing between reflectors 9 and 10 and delineated by curved rays "e" and "f" to exhibit a pronounced waist at a point midway between the two reflectors when their geometric relationship is as described above. Further, by this means efficient illumination without spillover of the plane reflector 5 is also assured. The two ellipsoid reflectors 9 and 10 are arranged to be mirror images of each other about a plane mid-way between them and normal to their mutual axis in order to take the fullest advantage of the inherent tendency for such a geometrically symmetric pair of oblique curved reflectors to cancel out at the second the aberrations introduced into the electromagnetic wave by the first. However in practice, even with the use of ellipsoid reflectors some beam divergence is unavoidable so, as shown above, this pair of reflectors does not have true electromagnetic symmetry and the transmitted wave contains an undesirable residual cross-polarised component. Replacement of the first plane reflector 2 of FIG. 1 by the hyperboloid curved reflector 8 of FIG. 5 introduces the ability to control the cross-polarised component actively rather than to rely passively on natural concellation of this unwanted wave. In FIG. 4(*a*) is shown the electric field distribution of the axially symmetric wave incident upon the oblique hyperboloid reflector 8 of FIG. 5 from the primary horn 1, where it is seen that at this point no cross-polarised component exists. Since the curved reflector 8 does not have symmetry about axis A—A' a cross-polarised component 10 in FIG. 4(*b*) is superimposed upon the principal component 9. By careful selection of the curvature of the hyperboloid reflector 8, this cross-component is made to have an exact, predetermined value. The wave is reflected from the hyperboloid reflector 8 towards the first oblique ellipsoid reflector 9, which upon reflecting the wave towards the second oblique ellipsoid reflector 10 in turn introduces further cross-polarisation distortion due to its oblique disposition. As shown in FIG. 4(*c*), the sum total of the cross-polarised component 10 is now therefore greater than that which would be produced by reflector 9 of FIG. 5 acting alone. The distorted wave then impinges upon the second oblique ellipsoid reflector 10 and is directed towards the plane reflector 5. Since the cross-polarisation distortion introduced by the second oblique ellipsoid reflector is greater than that introduced by the first oblique ellipsoid reflector acting alone, as explained above, it is possible by arranging for the hyperboloid reflector 8 to add the correct amount of distortion to that of the first ellipsoid reflector 9 to secure complete cancellation of the aggregrate cross-polarised component by the second ellipsoid reflector 10. Thus the wave incident upon the plane reflector 5 from the second oblique ellipsoid reflector 10 contains no cross-polarised component and its electric field distribution is as in FIG. 4(*a*). Since the plane reflector 5 has symmetry about axis B—B′ it introduces no cross-polarisation distortion and the axially symmetric beam radiated by the primary horn 1 is reconstituted as an axially symmetric beam focussed on focal point $F_2'$. Since the focal point $F_2'$ is made to coincide with that of the dual-reflector aerial 6*a*, 6*b*, the beam is then radiated into space as an axially symmetric, directed plane wave along the axis of the main reflector 6*a*. Thus for the first time is produced a four-reflector beam-waveguide feeder system for a satellite communications aerial system wherein, by application of the principles of electromagnetic wave theory, spillover of microwave energy from the reflectors used within the system is prevented while permitting efficient illumination of the reflectors, and by the use of a new invention giving positive control over the cross-polarisation distortion arising from the use of oblique curved reflectors, true axial symmetry and therefore mode purity of the transmitted microwave beam is obtained, along with complete suppression of cross-polarised waves generated within the beam-waveguide feeder system.

Although the operation of the present invention is explained primarily in terms of a transmitting aerial system, an illustration of its application to a receiving aerial system is also in order. As explained above and illustrated in FIG. 6, due to the finite size of the reflectors relative to a wavelength, the rays within the beam waveguide system are not straight but curved. Therefore at focal point $F_2'$ the transmitted wave is not in fact brought to a true point focus but instead is distributed over a closely defined area within a plane normal to the beam axis and containing point $F_2'$, within which area there is a fixed amplitude and phase distribution of the energy within the wave. In order to make efficient use of this energy and to produce the desired narrow-beam directed plane wave along its axis, the dual-reflector aerial comprising main reflector 6*a* and subreflector 6*b* is designed according to the principles of wave theory and therefore deviates in shape from the geometrical designs of Gregory and Cassegrain. Such an aerial will, upon being irradiated by a plane wave incident upon its axis, focus that wave into an area in the plane of focal point $F_2'$ such that the spatial distribution of the energy within that area is identical to that of the wave fed to the aerial during transmission. Feeding the beam waveguide from the region of focal point $F_2'$ with this distributed wave as distinct from a spherical wave emanating from $F_2'$ has the effect that the amplitude and phase distributions of the energy within the wave are such that the process occurring during the transmission mode is exactly reversed and the wave is brought to a point focus at $F_1'$ with its axial symmetry and mode purity unchanged. This is in full accordance with the principle of reciprocity of a lossless network and an aerial system designed according to the principles of wave theory and incorporating a beam-waveguide feeder system constructed according to the present invention is said to be "reciprocal" and will both transmit and receive microwave radio signals without loss or distortion.

The present invention is found to confer a further advantage in addition to the original aims of the invention in that, although for the purpose of controlling cross-polarisation distortion it is possible to use a convex hyperbolic reflector for reflector 8 in FIG. 5, if in fact this reflector is made concave as is shown in FIG. 5, it provides a degree of focussing of the beam in addition to its prime function of correcting axial asymmetry. As a result the distance from focal point $F_1'$ along the axis of the beam to the first ellipsoid reflector 9 is reduced relative to the case where the first reflector in the system is plane. Thus for a given set of reflectors 8, 9, 10, 5 the necessary feed horn 1 is closer to the first reflector 8 and has a smaller aperture dimension 1*a* than would be the case if a plane first reflector were to be used, making for a smaller, lighter and more convenient horn assembly. Alternatively, for a given size of horn it is possible for the two ellipsoid reflectors 9 and 10 and plane reflector 5 to be reduced in size relative to the sizes necessary if the first reflector were plane. It is also possible to take partial advantage of both of these benefits in order to arrive at the system providing the best possible configuration for a given application.

Obviously, numerous additional modifications and variations of the present invention are possible in the light of the above teachings. It is therefore to be understood that within the scope of the appended claims, the invention may be practised otherwise than as specifically described herein.

What we claim is:

1. A microwave aerial system comprising:

a microwave aerial capable of elevation and azimuthal rotation; and a primary feed system including:

a microwave horn to generate a rotationally symmetric beam; and a plurality of reflectors including a plane reflector and at least one set of three rotationally asymmetric curved reflectors spaced therefrom and comprising one pair of rotationally asymmetric curved reflectors being mirror images of each other and arranged in fixed facing relationship where the said pair of reflectors are together arranged in fixed relationship to the third rotationally asymmetric curved reflector of the said set of three reflectors, whereby the asymmetrical properties are compensated by controlled opposite radiation distribution characteristics so that the electrical field distribution at the aerial aperture is rotationally symmetric;

said horn being maintained fixed in position during elevation and azimuth rotation of the aerial whereas said plane reflector can turn with an elevation and azimuth rotation while the curved reflectors stay fixed during the elevation rotation, said plurality of curved reflectors being so shaped and positioned as to secure the maximum efficiency of use of the areas of all of the reflectors contained within the said aerial system by controlling the divergent nature of the transmitted beam to prevent the spilling-over of microwave radiation.

2. An aerial system according to claim 1, wherein said facing pair of rotationally asymmetric curved reflectors are ellipsoid reflectors so placed that a beam incident from a focal point of the first reflector and illuminating efficiently the surface of the first reflector will be reflected towards the second reflector in such a way that the beam will illuminate the entire surface of the second reflector having cross-section area equal to that of the first reflector without any of the energy of the beam spilling over the edge of the second reflector, and vice versa.

3. An aerial system according to claim 1, wherein said third rotationally asymmetric curved reflector is a hyperboloid reflector of such curvature that the cross-polarised component introduced into the transmitted beam by the use of asymmetric curved reflectors is fully cancelled within the said primary feed system.

4. An aerial system according to claim 1, wherein said third rotationally asymmetric curved reflector is a concave reflector providing additional focussing of the beam.

5. An aerial system according to claim 1, wherein said aerial system further comprises a primary feed system including a horn, a first hyperboloid reflector, a first ellipsoid reflector, a second ellipsoid reflector, a plane reflector, and an aerial including a subreflector and a main reflector, the aerial and the plane reflector being together turnable around an elevation rotary axis, the whole of the said reflectors being together turnable around an azimuth rotary axis, the said reflectors being so disposed that a beam emanating from the horn is reflected by the hyperboloid reflector to the first ellipsoid reflector, thence to the second ellipsoid reflector, from there to the plane reflector and thence to the aerial to be radiated into sapce along its axis as a plane wave, a plane wave incident upon the aerial along its axis being similarly reflected into the horn by the reverse process.

* * * * *